US005553840A

United States Patent [19]

Arikawa

[11] Patent Number: 5,553,840

[45] Date of Patent: Sep. 10, 1996

[54] BILL RECEIVING AND FEEDING-OUT APPARATUS

[75] Inventor: Junichi Arikawa, Kawaguchi, Japan

[73] Assignee: Laurel Bank Machines Co., Ltd., Tokyo, Japan

[21] Appl. No.: 353,985

[22] Filed: Dec. 6, 1994

Related U.S. Application Data

[63] Continuation of Ser. No. 121,893, Sep. 16, 1993, abandoned.

[30] Foreign Application Priority Data

Sep. 17, 1992 [JP] Japan ..... 4-248267
Sep. 9, 1993 [JP] Japan ..... 5-224151

[51] Int. Cl.[6] ..... B07C 5/02

[52] U.S. Cl. ..... 271/3.08; 209/534; 271/186

[58] Field of Search ..... 194/206; 209/534; 271/3.08, 163, 177, 186

[56] References Cited

U.S. PATENT DOCUMENTS 4,549,661 10/1985 Morishita et al. ..... 271/186 X
4,625,870 12/1986 Nao et al. ..... 271/186 X
4,979,727 12/1990 Koike et al. ..... 271/186 X

FOREIGN PATENT DOCUMENTS 57-81051 5/1982 Japan ..... 271/186
59-3595 1/1984 Japan .

*Primary Examiner*—F. J. Bartuska
*Attorney, Agent, or Firm*—Cushman, Darby & Cushman

[57] ABSTRACT

A bill receiving and feeding-out apparatus for a bill receiving and dispensing machine including a bill accommodating box for accommodating bills, a bill reversing mechanism which includes a bill reversing passage for reversing and feeding bills into the bill accommodating box, a bill non-reversing passage for feeding bills into the bill accommodating box without reversing them, a bill feeding-out passage for feeding out bills from the bill accommodating box to a transporting passage, and a bill receiving and feeding-out mechanism which includes a bill accommodating passage connected to the downstream end of the bill reversing passage and to the upper portion of the bill accommodating box at the downstream end thereof, a bill receiving and feeding-out opening facing the downstream end of the bill non-reversing passage and the upstream end of the bill feeding-out passage and a bill accommodating and feeding-out passage connected to the bill receiving and feeding-out opening at one end and to the upper portion of the bill accommodating box at the other end, the bill reversing mechanism being disposed above the bill receiving and feeding-out mechanism, the bill receiving and feeding-out apparatus further including an adjusting members for enlarging or narrowing the bill receiving and feeding-out opening.

20 Claims, 9 Drawing Sheets

BILL RECEIVING AND FEEDING-OUT APPARATUS

This application is a Continuation-in-Part of Ser. No. 08/121,893 filed Sep. 16, 1993, now abandoned.

BACKGROUND OF THE INVENTION

The present invention relates to a bill receiving and feeding-out apparatus and, in particular, to such an apparatus capable of receiving bills or bank notes (collectively referred to as "bills" in this specification) in such a manner that either the front sides or the back sides thereof face upwardly and feeding-out received bills.

DESCRIPTION OF PRIOR ART

Japanese Patent Application Laid Open No. 59-3595 discloses a bill receiving and dispensing machine having a bill receiving and feeding-out apparatus which can receive bills so as to accommodate them in such a manner that either the front sides or the back-sides thereof face upwardly and feeding-out received bills.

In such a bill receiving and feeding-out apparatus, bills deposited into a transaction opening are discriminated by a first bill discriminating section provided in a first bill transporting passage as to whether they are genuine or counterfeit, their denominations and whether the front sides or back sides thereof face upwardly and the genuine bills are fed to a reversing device which is adapted for causing either the front sides or back sides of the bills face upwardly. In accordance with the results of discrimination made by the first discriminating means, when the bills are to be accommodated so that the front sides thereof face upwardly, the received bills the back sides of which face upwardly are reversed by the reversing device and the received bills the front sides of which face upwardly are not reversed so that they are stored in a first storing section. On the other hand, when the bills are to be accommodated so that the back sides thereof face upwardly, the received bills the front sides of which face upwardly are reversed by the reversing device and the received bills the back sides of which face upwardly are not reversed so that they are stored in a first storing section. Afterward, when a bill receiving instruction signal is input by a customer, the bills stored in the first storing section are fed out by a feed-out means provided at the bottom portion of the first storing section to a second bill transporting passage disposed below the first storing section and are discriminated by a second discriminating means provided in the second bill transporting passage as to whether the bills are genuine or counterfeit and their denominations. The genuine bills are sorted in accordance with their denominations and are accommodated in corresponding bill accommodating boxes. When dispensing bills, the numbers of bills to be dispensed from the respective bill accommodation boxes are calculated in accordance with the amount of bills to be dispensed and the bills are fed to the second bill transporting passage. Then, the denominations of bills are discriminated by the second discriminating means and the bills are stored in a second storing section provided in the vicinity of the transaction opening so that they are taken out by a customer via the transaction opening.

In this bill receiving and dispensing machine, it is possible to accommodate the deposited bills in bill accommodating boxes in accordance with their denominations in such a manner that either the front sides or the back sides thereof face upwardly and, therefore, to dispense bills either the front sides or the back sides of which face upwardly.

However, in this bill receiving and feeding-out apparatus, since bills are fed out from the first storing section by the feed-out means provided at the bottom portion of the first storing section, after the bills were stored in the first storing section in such a manner that either the front sides or the back sides thereof face upwardly, there arises a problem of the size of the apparatus inevitably becoming large.

SUMMARY OF THE INVENTION

It is, therefore, an object of the present invention to provide a compact bill receiving and feeding-out apparatus which can accommodate bills so that either the front sides or the back sides thereof face upwardly and feed out bills as occasion demands.

The above and other objects of the present invention can be accomplished by a bill receiving and feeding-out apparatus for a bill receiving and dispensing machine connectable to a transporting passage in the bill receiving and dispensing machine comprising a bill accommodating box for accommodating bills, a bill reversing mechanism which comprises a bill reversing passage for reversing and feeding bills into the bill accommodating box, a bill non-reversing passage for feeding bills into the bill accommodating box without reversing them, a bill feeding-out passage for feeding out bills from the bill accommodating box to the transporting passage, a first gate means for selectively taking in acceptable bills in accordance with the results of discrimination made by a discriminating means provided in the transporting passage as to whether or not bills are acceptable, the denominations of bills and whether the front sides or the back sides of bills face upwardly and second gate means for selectively feeding bills to either the bill reversing passage or the bill non-reversing passage based upon the results of discrimination made by the discriminating means, and a bill receiving and feeding-out mechanism which comprises a bill accommodating passage connected to the downstream end portion of the bill reversing passage and connected to the upper portion of the bill accommodating box at the downstream end portion thereof for feeding bills from the bill reversing passage to the bill accommodating box, a bill receiving and feeding-out opening facing the downstream end portion of the bill non-reversing passage and the upstream end portion of the bill feeding-out passage and a bill accommodating and feeding-out passage connected to the bill receiving and feeding-out opening at one end and to the upper portion of the bill accommodating box at the other end and adapted for feeding bills into the bill accommodating box and feeding out bills from the bill accommodating box, said bill reversing mechanism being disposed above the bill receiving and feeding-out mechanism, said bill receiving and feeding-out apparatus further comprising an adjusting means for enlarging the bill receiving and feeding-out opening so as to face the bill non-reversing passage and the bill feeding-out passage when accommodating bills into the bill accommodating box and narrowing the bill receiving and feeding-out opening so as to face only the bill feeding-out passage when feeding out bills from the bill accommodating box.

In a preferred aspect of the present invention, bill accommodating rollers are provided in the bill accommodating passage and bill accommodating and feeding-out rollers are provided in the bill accommodating and feeding-out passage.

In a further preferred aspect of the present invention, an elevator plate movable vertically is provided in the bill accommodating box for holding bills so as to be stacked on the upper surface thereof.

In a still further preferred aspect of the present invention, vane wheels are provided at a position opposite to the bill accommodating rollers with respect to the bill accommodating passage and vane wheels are provided at a position opposite to the bill accommodating and feeding-out rollers with respect to the bill accommodating and feeding-out passage.

In a yet further preferred aspect of the present invention, the circumferential surface of each of the bill accommodating rollers is made of a friction material and the circumferential surface of each of the bill accommodating and feeding-out rollers is made of a friction material.

DESCRIPTION OF THE PREFERRED EMBODIMENT

Figure 1:
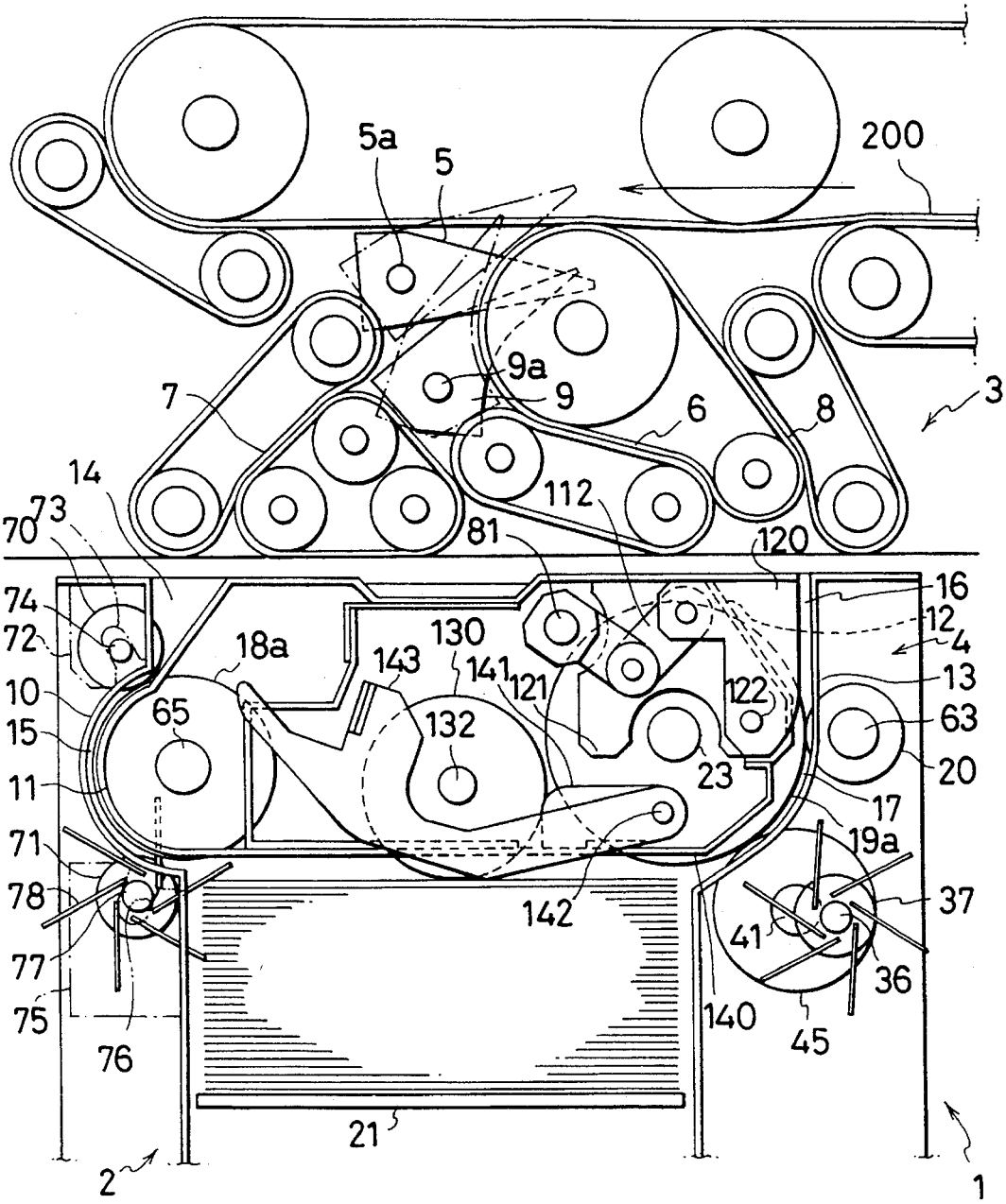
FIG. 1 is a schematic front view of a bill receiving and feeding-out apparatus for a bill receiving and dispensing machine which is an embodiment of the present invention.

FIG. 1 is a schematic front view of a bill receiving and feeding-out apparatus for a bill receiving and dispensing machine which is an embodiment of the present invention. In this embodiment, a bill receiving and feeding-out apparatus has a bill accommodating box and is adapted for accommodating bills of a specified denomination in the bill accommodating box in such a manner that the front sides of the bills face upwardly and feeding out the stored bills from the bill accommodating box. Therefore, a bill receiving and dispensing machine has bill accommodating boxes the number of which is equal to that of denominations of bills to be handled.

Referring to FIG. 1, bills deposited into a transaction opening (not shown) are transported in a transporting passage 200 and a discriminating means discriminates whether or not the bills are counterfeit and whether or not they are foreign bills, namely, whether or not they are acceptable, the denominations thereof and whether the front sides thereof face upwardly or the back sides thereof face upwardly. The bills are further transported toward a bill receiving and feeding-out apparatus 1 as indicated by an arrow. Discrimination signals are input to a control unit (not shown) from the discriminating means.

Each bill receiving and feeding-out apparatus 1 comprises a bill accommodating box 2 for accommodating bills of corresponding denomination, a bill reversing mechanism 3 for reversing and feeding bills or feeding the bills without reversing so as to be accommodated in the bill accommodating box 2 in such a manner that the front sides thereof face upwardly and a bill receiving and feeding-out mechanism 4 for feeding the bills into the bill accommodating box 2 when the bills are to be received and feeding out the bills stored in the bill accommodating box 2 to the transporting passage 200 when the bills are to be dispensed. The bill receiving and feeding-out mechanism 4 is connected to the lower portion of the bill reversing mechanism 3.

The bill reversing mechanism 3 includes a first gate member 5 swingable about a shaft *5a* between a taking-in position where the first gate member 5 projects into the transporting passage 200 and a retracted position where the first gate member 5 is retracted from the transporting passage 200 and when the control unit judges, in accordance with a discrimination signal from the discriminating means, that the bill of corresponding denomination has been fed immediately upstream of the first gate member 5 of the bill receiving and feeding-out apparatus 1, it actuates the first gate member 5 of the bill receiving and feeding-out apparatus 1 so as to be located at its taking-in position indicated by a chain line in FIG. 1, thereby taking the bill in the bill receiving and feeding-out apparatus 1. On the other hand, when the control unit judges that a bill of other denominations than the corresponding one has been transported, it does not actuate the first gate member 5 and holds it at its retracted position indicated by a dotted line in FIG. 1, thereby further transporting the bill downstream in the transporting passage 200. Further, when dispensing bills stored in the bill accommodating box 2, the first gate member 5 is held at its retracted position, thereby transporting the bills fed out from the bill accommodating box 2 downstream in the transporting passage 200.

The bill reversing mechanism 3 includes a bill receiving passage 6 through which bills are fed to the bill receiving and feeding-out mechanism 4 without being reversed, a bill reversing and receiving passage 7 through which bills are reversed and fed to the bill receiving and feeding-out mechanism 4, a bill dispensing passage 8 through which bills stored in the bill accommodating box 2 are fed to the transporting passage 200 for dispensation and a second gate member 9 swingable about a shaft *9a* which is selectively located at a position indicated by a dotted line in FIG. 1 or a position indicated by a chain line by the control unit based upon the discrimination signal input from the discriminating means and is adapted for selectively feeding bills taken in the bill receiving and feeding-out apparatus 1 to the bill receiving passage 6 or the bill reversing and receiving passage 7.

When the control unit judges, based upon the discrimination signal input from the discriminating means, that it is necessary to reverse the bill taken in the bill receiving and feeding-out apparatus 1 for accommodating the bills in the bill accommodating box 2 in such a manner that the front side thereof faces upwardly, it actuates and positions the second gate member 9 at the position indicated by a dotted line in FIG. 1, thereby feeding the bill into the bill reversing and receiving passage 7. On the other hand, when the control unit judges that it is unnecessary to reverse the bill for accommodating bills in the bill accommodating box 2 in such a manner that the front side thereof faces upwardly, it actuates and positions the second gate member 9 at the position indicated by a chain line in FIG. 1, thereby feeding the bill into the bill receiving passage 6.

The bill receiving and feeding-out mechanism 4 connected to the lower portion of the bill reversing mechanism 3 includes guide members 10, 11 provided on the left side and guide members 12, 13 provided on the right side in FIG. 1. The guide members 10, 11 form a bill receiving opening 14 at a position facing the bill reversing and receiving passage 7 and also form a bill accommodating passage 15 for guiding the bills received in the bill receiving opening 14 into the bill accommodating box 2. On the other hand, the guide members 12, 13 form a bill receiving and dispensing opening 16 at a position facing the bill receiving passage 6 and the bill dispensing passage 8 and also form a bill accommodating and feeding-out passage 17 for guiding the bills received in the bill receiving and dispensing opening 16 into the bill accommodating box 2 and guiding the bills stored in the bill accommodating box 2 to the bill dispensing passage 8.

The bill receiving and feeding-out mechanism 4 further includes a pair of accommodating rollers 18*a*, 18*b* for accommodating bills into the bill accommodating box 2 along the bill accommodating passage 15 and two pairs of accommodating and feeding-out rollers 19*a*, 19*b*, 19*c*, 19*d* (FIG. 1 shows only the accommodating and feeding-out roller 19*a*) for accommodating bills into the bill accommodating box 2 along the bill accommodating and feeding-out passage 17 when bills are to be received and feeding out the bills stored in the bill accommodating box 2 to the bill dispensing passage 8 along the bill accommodating and feeding-out passage 17 when bills are to be dispensed. The guide members 10, 11 facing each other are curved along the circumferential surfaces of the accommodating rollers 18*a*, 18*b* and the guide members 12, 13 facing each other are curved along the circumferential surfaces of the accommodating and feeding-out rollers 19*a*, 19*b*, 19*c*, 19*d*. The accommodating rollers 18*a*, 18*b* are disposed so as to project from the guide member 11 into the bill accommodating passage 15 and the accommodating and feeding-out rollers 19*a*, 19*b*, 19*c*, 19*d* is disposed so as to project from the guide member 12 into the bill accommodating and feeding-out passage 17. Further, feed rollers 20 are provided so as to project from the guide member 13 and abut against the accommodating and feeding-out rollers 19*a*, 19*d*. The guide members 10, 13 extend downwardly and form side walls of the bill accommodating box 2. In the bill accommodating box 2, a elevator plate 21 is provided so as to be movable vertically and form a bottom portion for supporting bills stored by the upper surface thereof.

Figure 2:
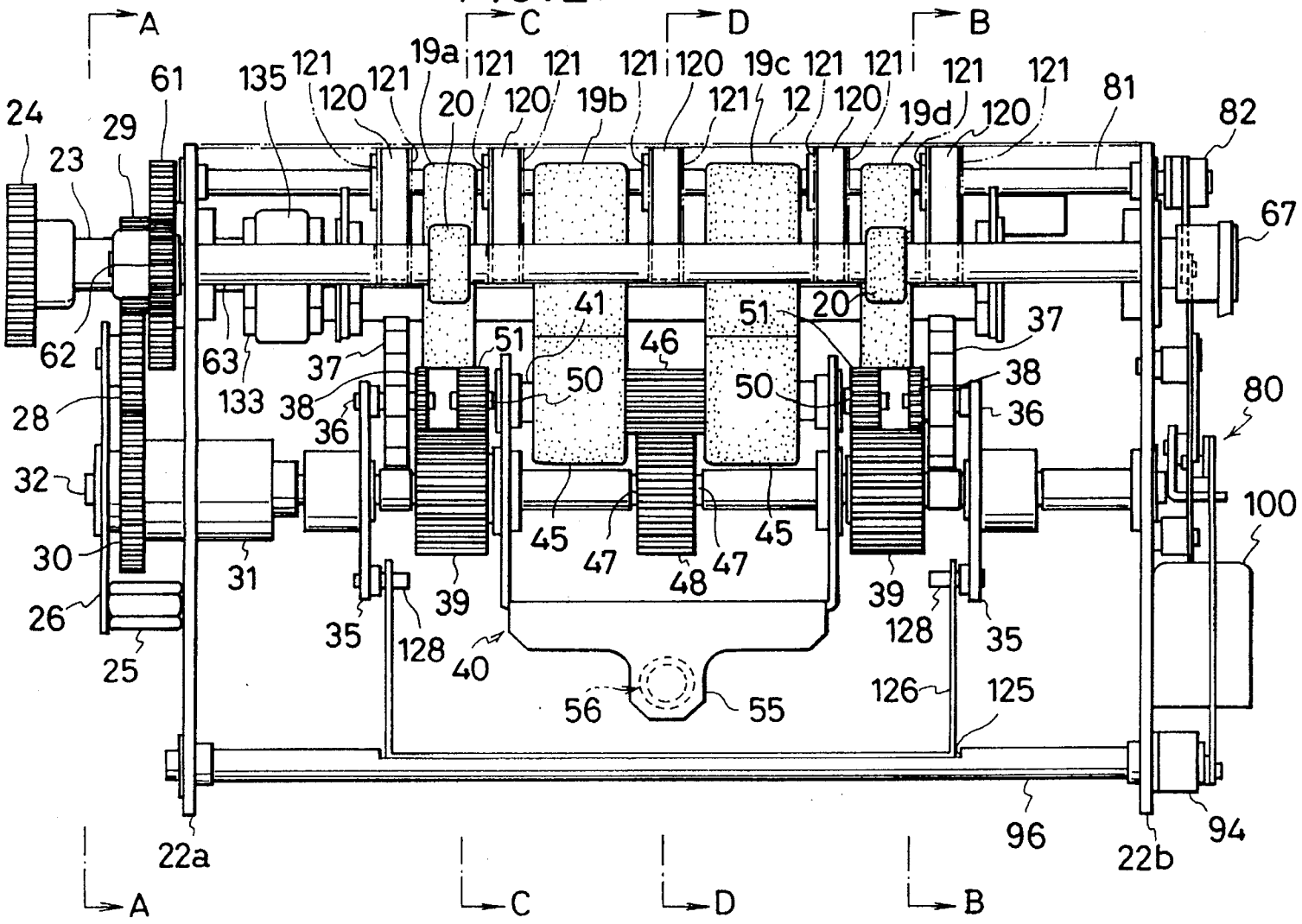
FIG. 2 is a schematic drawing showing a right side view of a bill receiving and feeding-out mechanism shown in FIG. 1.
Figure 3:
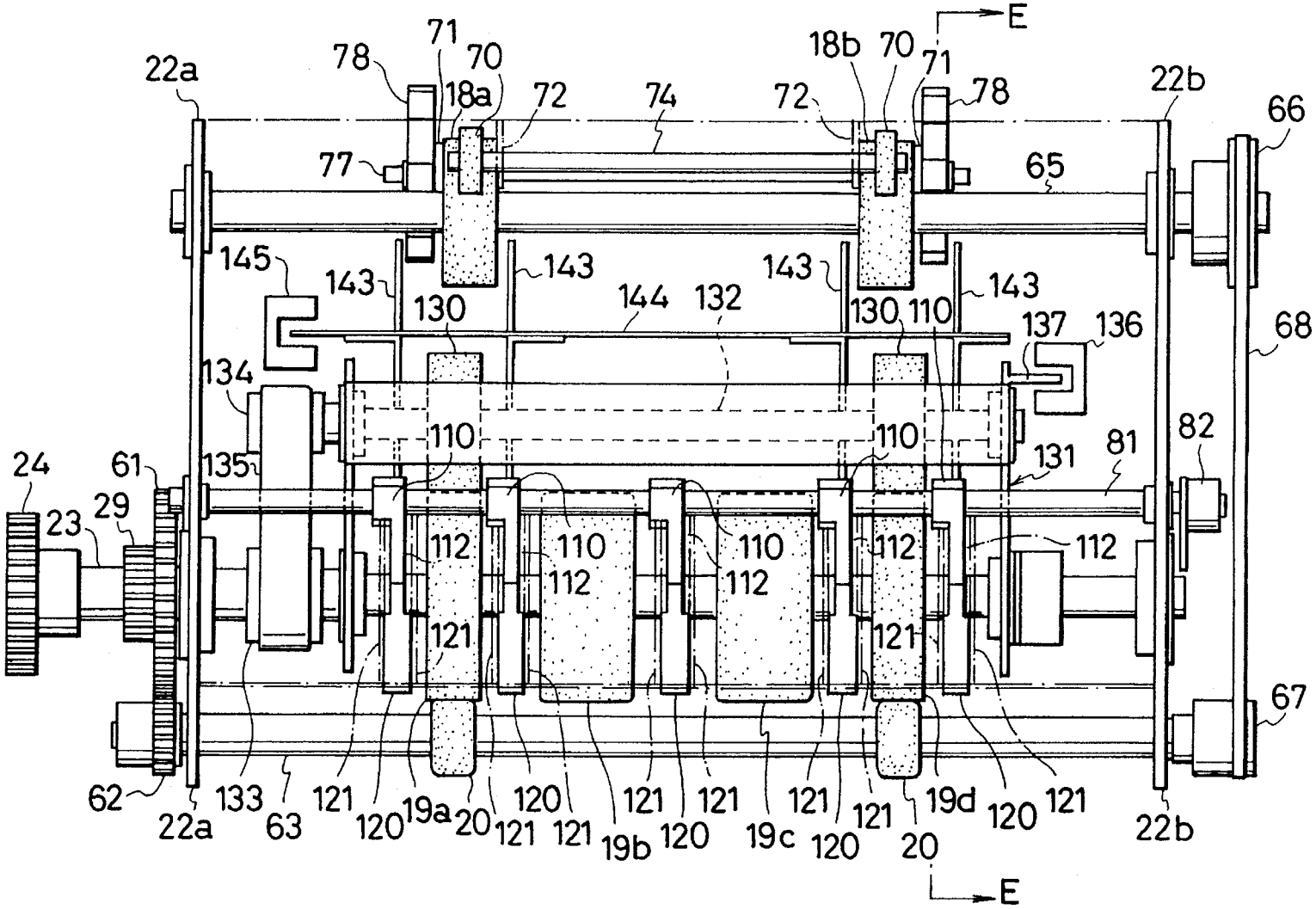
FIG. 3 is a schematic drawing showing a plan view of a bill receiving and feeding-out mechanism shown in FIG. 2.

FIG. 2 is a schematic drawing showing a right side view of a bill receiving and feeding-out mechanism 4 shown in FIG. 1 and FIG. 3 is a schematic drawing showing a plan view thereof.

In FIGS. 2 and 3, a shaft 23 is rotatably supported by frames 22*a*, 22*b* which form a part of the body (not shown) of the bill receiving and feeding-out apparatus 1. The two pairs of accommodating and feeding-out rollers 19*a*, 19*b*, 19*c*, 19*d* are fixed to the shaft 23. A pair of the accommodating and feeding-out rollers 19*a*, 19*b* and a pair of the accommodating and feeding-out rollers 19*c*, 19*d* are spaced from each other at the same interval. The outer circumferences of the accommodating and feeding-out rollers 19*a*, 19*b*, 19*c*, 19*d* are made of a high friction material. A gear 24 is fixed to one end portion of the shaft 23 and is driven by a first drive means (not shown) so as to be rotated clockwise in FIG. 1 when receiving bills and be rotated counterclockwise in FIG. 1 when dispensing bills.

Figure 4:
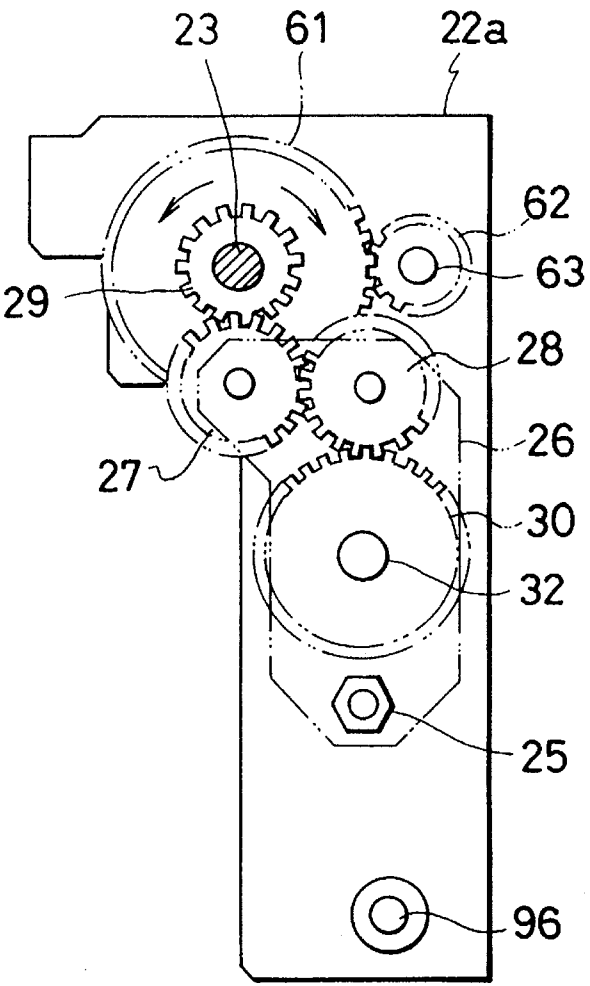
FIG. 4 is a schematic drawing showing a cross sectional view taken on line A—A in FIG. 2.

FIG. 4 is a schematic drawing showing a cross sectional view taken on line A—A in FIG. 2. As shown in FIGS. 2, 3 and 4, a fixation member 25 is fixed to the outer side of the frame 22*a* and a support member 26 is fixed to the fixation member 25. The support member 26 rotatably supports gears 27, 28 meshing with each other. The gear 27 meshes with a gear 29 fixed to the shaft 23 and the gear 28 meshes with a gear 30 fixed to a torque limiter 31.

A shaft 32 is rotatably supported on the support member 26 and the frames 22*a*, 22*b*, and the torque limiter 31 is provided on the shaft 32. Therefore, the gear 30 fixed to the torque limiter 31 meshes with the gear 28 and the gear 29 fixed to the shaft 23 meshes with the gear 27, whereby the driving force produced by driving the gear 29 is transmitted to the gear 30 via the gears 27, 28 so that the gear 30 is rotated in the opposite direction to that of the gear 29.

The torque limiter 31 is adapted for causing the shaft 32 to slip with respect to the gear 30 when the difference between torque produced by the driving force transmitted to the gear 30 from the first drive means via the gear 24, the gear 29, the gear 27 and the gear 28 and torque produced in the shaft 32 when receiving or dispensing bills is greater than or equal to a predetermined value so that the rotational force of the gear 30 is prevented to be transmitted to the shaft 32. On the contrary, when the difference therebetween is lower than the predetermined value, the torque limiter 31 permits the rotational force of the gear 30 to be transmitted to the shaft 32.

Figure 5:
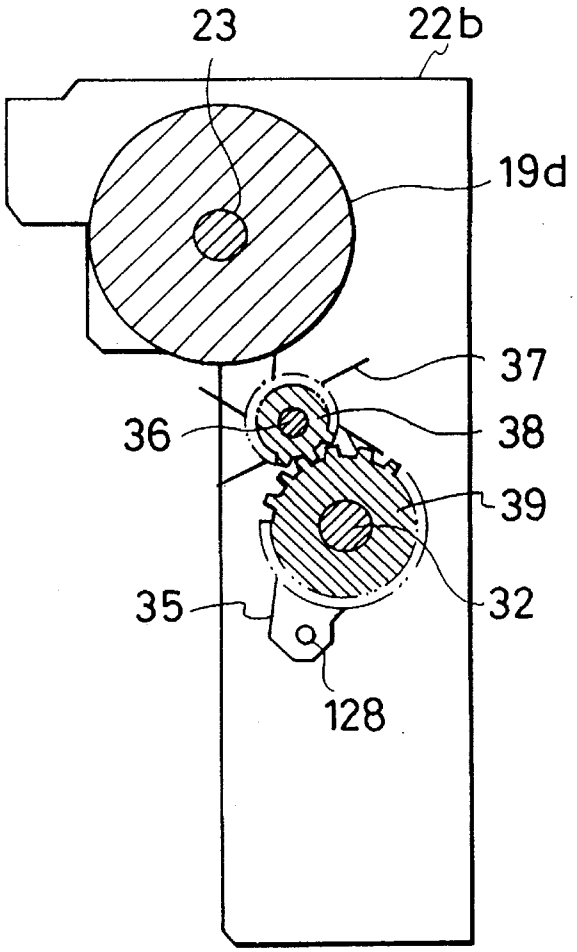
FIG. 5 is a schematic drawing showing a cross sectional view taken on line B—B in FIG. 2.

FIG. 5 is a schematic drawing showing a cross sectional view taken on line B—B in FIG. 2.

Referring to FIGS. 2 and 5, a pair of support members 35 are rotatably supported by the shaft 32 mounted on the frames 22*a*, 22*b*. Vane wheels 37 made of an elastic material such as rubber are rotatably supported by a shaft 36 fixed to the upper portion of the support members 35 and a gear 38 is integrally fixed to each of the vane wheels 37.

Figure 6:
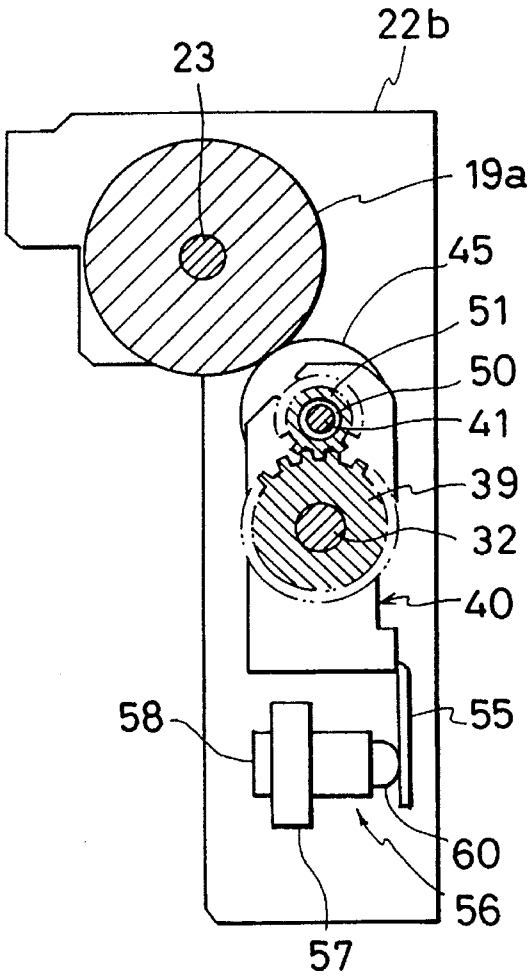
FIG. 6 is a schematic drawing showing a cross sectional view taken on line C—C in FIG. 2.

FIG. 6 is a schematic drawing showing a cross sectional view taken on line C—C in FIG. 2.

Referring to FIGS. 2 and 6, gears 39 each of which meshes with one of gears 38 are rotatably supported by the shaft 32 between the support members 35. A support member 40 is rotatably supported by the shaft 32 between the pair of gears 39 at two points. A shaft 41 is rotatably supported by the upper portion of the support member 40.

Figure 7:
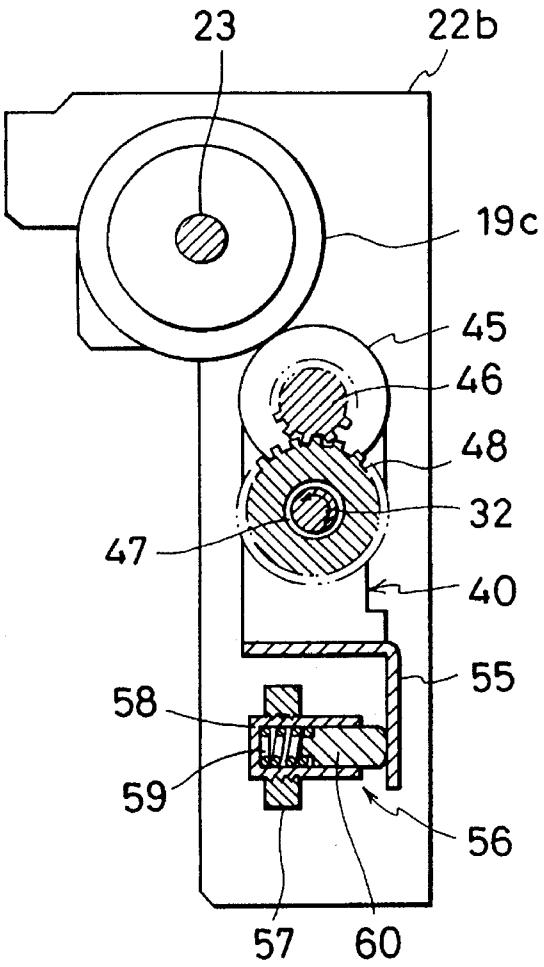
FIG. 7 is a schematic drawing showing a cross sectional view taken on line D—D in FIG. 2.

FIG. 7 is a schematic drawing showing a cross sectional view taken on line D—D in FIG. 2.

A pair of separation rollers 45 are fixed to the shaft 41. The circumference of each separation roller 45 is made of a high friction material and abuts against one of the accommodating and feeding-out rollers 19*b*, 19*c*, whereby bills can be held between the circumferences of the separation rollers 45 and those of the accommodating and feeding-out rollers 19*b*, 19*c*. Further, a gear 46 is fixed to the central portion of the shaft 41 between a pair of the separation rollers 45 and a gear 48 is provided on the central portion of the shaft 32, which meshes with the gear 46 via a one-way clutch 47. The one-way clutch 47 is adapted for transmitting the driving force of the shaft 32 to the gear 48 only when the shaft 32 is rotated clockwise in FIG. 7 with respect to the gear 48 but not transmitting the driving force of the shaft 32 to the gear 48 when the shaft 32 is rotated counterclockwise in FIG. 7 with respect to the gear 48. In other words, the one-way clutch 47 is adapted for transmitting the driving force of the gear 48 to the shaft 32 only when the gear 48 is rotated counterclockwise in FIG. 7 with respect to the shaft 32 but not transmitting the driving force of the gear 48 to the shaft 32 when the gear 48 is rotated clockwise in FIG. 7 with respect to the shaft 32.

Referring to FIGS. 2 and 3, at opposite ends of the shaft 41 to which the separation rollers 45 are fixed, there are provided gears 51 each of which meshes with one of the gears 39 via a one-way clutch 50. Each of the one-way clutch 50 is adapted for transmitting the rotational force of the shaft 41 to one of the gears 51 only when the shaft 41 is rotated counterclockwise in FIG. 6 with respect to the gears 51, thereby rotating the vane wheels 37 counterclockwise via the gears 39 and the gears 38.

Therefore, referring to FIGS. 2, 5, 6 and 7, when receiving bills, the accommodating and feeding-out rollers 19*a*, 19*b*, 19*c*, 19*d* are rotated clockwise in FIG. 1 by the first drive means via the gear 24 so that the driving force of the first drive means is transmitted from the gear 24 to the gear 30 via the gear 29, the gear 27 and the gear 28, whereby the gear 30 is rotated counterclockwise and the counterclockwise driving force of the gear 30 is transmitted to the shaft 32 via the torque limiter 31.

Simultaneously, the separation rollers 45 abutting against the accommodating and feeding-out rollers 19*b*, 19*c* are rotated counterclockwise so that the gear 48 is rotated clockwise via the gear 46. As a result, the gear 48 is rotated clockwise in FIG. 7 and the one-way clutch 47 disconnect the shaft 32 and the gear 48. Therefore, the shaft 32 is rotated counterclockwise by the driving force transmitted from the gear 30.

On the other hand, the counterclockwise rotational force of the separation rollers 45 is transmitted to the one-way clutches 50 via the shaft 41. Since each one-way clutch 50 is adapted for transmitting the rotational force of the shaft 41 to one of the gears 51 only when the shaft 41 is rotated counterclockwise in FIG. 6 with respect to the gear 51, the vane wheels 37 are rotated counterclockwise via the gears 39 and the gears 38.

On the contrary, when dispensing bills, the accommodating and feeding-out rollers 19*a*, 19*b*, 19*c*, 19*d* are rotated counterclockwise in FIG. 1 by the first drive means via the gear 24 so that the driving force of the first drive means is transmitted from the gear 24 to the gear 30 via the gear 29, the gear 27 and the gear 28, whereby the gear 30 is rotated clockwise. As a result, the shaft 32 can be rotated clockwise by the driving force transmitted from the gear 30 via the torque limiter 31.

However, simultaneously, the separation rollers 45 abutting against the accommodating and feeding-out rollers 19*b*, 19*c* are rotated clockwise so that the gear 48 is rotated counterclockwise via the gear 46. As a result, the driving force of the gear 48 is transmitted to the shaft 32 via the one-way clutch 47, whereby the shaft 32 is rotated counterclockwise. Therefore, since the difference in torque between the gear 30 and the shaft 32 becomes greater, the torque limiter 31 causes the shaft 32 to slip with respect to the gear 30 and the shaft 32 is rotated counterclockwise by the driving force transmitted from the gear 48.

On the contrary, when dispensing bills, if two or more bills are simultaneously taken out from the bill accommodating box 2 to between the accommodating and feeding-out rollers 19*b*, 19*c* and the separation rollers 45, since a frictional force produced between adjacent bills is low, slippage instantaneously occurs between the accommodating and feeding-out rollers 19*b*, 19*c* and the separation rollers 45. As a result, although the accommodating and feeding-out rollers 19*a*, 19*b*, 19*c*, 19*d* are rotated counterclockwise in FIG. 1, the driving force transmitted to the accommodating and feeding-out rollers 19*a*, 19*b*, 19*c*, 19*d* from the first drive means via the gear 24 is not transmitted to the separation rollers 45 and, therefore, neither the gear 46 nor the gear 48 are rotated. Accordingly, since the shaft 32 is not rotated by the driving force transmitted via the separation rollers 45, the difference in torque between the gear 30 and the shaft 32 becomes small and the driving force of the gear 30 is transmitted to the shaft 32 via the torque limiter 31, whereby the shaft 32 is rotated clockwise. As a result, the rotational force of the shaft 32 is transmitted to the gear 48 by the one-way clutch 47 so that the separation rollers 45 are rotated counterclockwise via the gear 46. As a consequence, a separation force acts on two or more bills taken out to between the accommodating and feeding-out rollers 19*b*, 19*c* and the separation rollers 45 from the accommodating and feeding-out rollers 19*b*, 19*c* and the separation rollers 45, whereby the bills are taken out one by one.

As shown in FIGS. 2, 6 and 7, the lower portion of the support member 40 rotatably supported by the shaft 32 is formed with a projection plate 55. A biasing device 56 is provided on the left side of the projection plate 55 in FIGS. 6 and 7 for biasing the support member 40 and abuts against the projection plate 55. The biasing device 56 is fixed to a support member 57 secured to the body of the bill accommodating box 2 and includes a cylindrical member 58 the outer circumference of which is formed with a thread and which is screwed into the support member 57, a compression spring 59 inserted into the cylindrical member 58 and a press member 60 which is inserted into the cylindrical member 58 and is adapted for pressing the projection plate 55 by a spring force of the compression spring 59 toward the right in FIGS. 6 and 7.

When the projection plate 55 is pressed by the thus constituted biasing device 56 toward the right in FIGS. 6 and 7, the support member 40 is biased counterclockwise about the shaft 32 so that the separation rollers 45 supported by the shaft 41 disposed at the upper portion of the support member 40 are pressed onto the circumferential surfaces of the accommodating and feeding-out rollers 19*b*, 19*c* by a predetermined pressure. Since this biasing device is supported by screwing the cylindrical member 58 into the support member 57, it is possible to set a spring force pressing the support member 40, therefore, a pressure for pressing the separation rollers 45 onto the circumferential surfaces of the accommodating and feeding-out rollers 19*b*, 19*c* in a desired manner by rotating and moving the cylindrical member 58 in the lateral direction in FIG. 7.

In addition to the gear 29, a gear 61 is fixed to the shaft 23 driven by the first drive means (not shown) via the gear 24. The gear 61 is disposed outside of the frame 22*a* and meshes with a gear 62. A shaft 63 is rotatably supported by the frames 22*a*, 22*b*, and the gear 62 and a pair of the feed rollers 20 are fixed to the shaft 63. A pair of the feed rollers 20 are provided so as to abut against the accommodating and feeding-out rollers 19*a*, 19*d*.

Accordingly, when the shaft 23 is rotated by the first drive means via the gear 24, the rotational force of the shaft 23 is transmitted to the shaft 63 via the gear 61 and the gear 62 and a pair of the feed rollers 20 are rotated in the opposite direction to that of the accommodating and feeding-out rollers 19*a*, 19*b*, 19*c* 19*d*, whereby it is possible to accommodate the bill held between the feed rollers 20 and the accommodating and feeding-out rollers 19*a*, 19*d* into the bill accommodating box 2 or take out the bill to the bill receiving and dispensing opening 16.

As shown in FIG. 3, a shaft 65 is rotatably mounted on the frames 22*a*, 22*b* in parallel with the shaft 63 and a pulley 66 is secured to the right end portion of the shaft 65 in FIG. 3 via a one-way clutch (not shown). A belt 68 is engaged with the pulley 66 and a pulley 67 fixed to the right end portion of the shaft 63 in FIG. 3 for transmitting the rotational force of the shaft 63 to the shaft 65. The one-way clutch provided between the shaft 65 and the pulley 66 can transmit the rotational force from the shaft 63 to the shaft 65 only when the shaft 63 is rotated counterclockwise in FIGS. 1 and 4.

A pair of the accommodating rollers 18*a*, 18*b* are fixed to the shaft 65 for accommodating the bills received in the bill receiving opening 14 into the bill accommodating box 2. As shown in FIG. 3, a pair of the accommodating rollers 18*a*, 18*b* are disposed between the frames 22*a*, 22*b* and when the shaft 63 is rotated counterclockwise in FIGS. 1 and 4 by the first drive means (not shown) via the gear 24, the rotational force is transmitted to the shaft 65 via the pulley 67, the belt 68, the pulley 66 and the one-way clutch, whereby the accommodating rollers 18*a*, 18*b* are rotated counterclockwise.

As shown in FIGS. 1 and 3, there are provided a pair of feed rollers 70 each of which abuts against one of the accommodating rollers 18*a*, 18*b* on the upper side of the accommodating rollers 18*a*, 18*b* and a pair of feed rollers 71 each of which abuts against one of the accommodating rollers 18*a*, 18*b* on the lower side of the accommodating rollers 18*a*, 18*b*.

Each of the feed rollers 70 is fixed to a shaft 74 rotatably engaged within a concave portion 73 formed in a support member 72 and is rotated together with the accommodating rollers 18*a*, 18*b*.

Each of the feed rollers 71 is fixed to a shaft 77 rotatably engaged within a concave portion 76 formed in a support member 75 and is rotated together with the accommodating rollers 18*a*, 18*b*.

The support members 72, 75 are fixed to a frame (not shown) respectively.

Vane wheels 78 are fixed to the opposite end portions of the shaft 77 and are adapted for leading bills received in the bill receiving opening 14 and transported within the bill accommodating passage 15 into the bill accommodating box 2.

The shaft 74 and the shaft 77 are biased by a biasing member (not shown) such as a spring toward the shaft 65, whereby the feed rollers 70 and the feed rollers 71 abut against the accommodating rollers 18*a*, 18*b* by a predetermined pressure.

A link mechanism 80 is provided on the right side of the frame 22*b* in FIG. 2.

As shown in FIGS. 2 and 3, a shaft 81 is rotatably supported by the frames 22*a*, 22*b* and one end portion of a rotation member 82 is fixed to the right end portion of the shaft 81.

Figure 8:
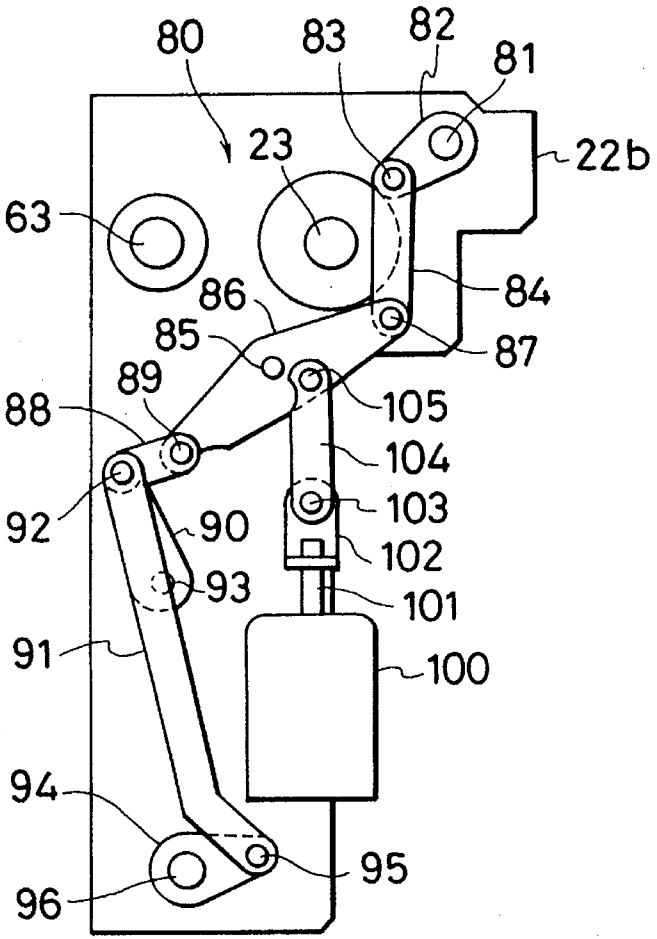
FIG. 8 is a schematic a right side view of FIG. 2 showing a link mechanism when bills are being accommodated in a bill accommodating and feeding-out box.
Figure 9:
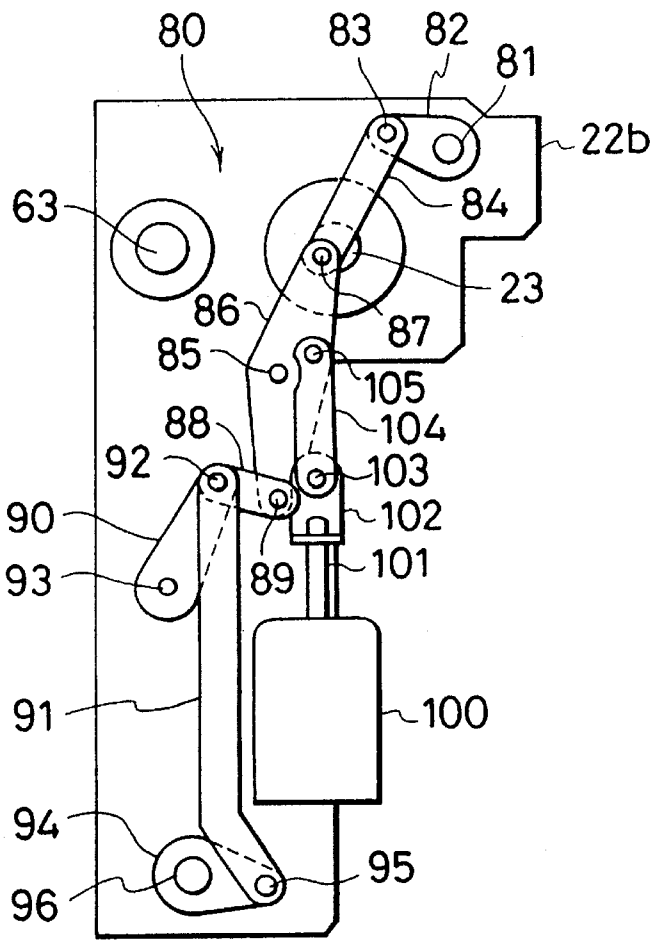
FIG. 9 is a schematic a right side view of FIG. 2 showing a link mechanism when bills are being fed out from a bill accommodating and feeding-out box.

FIGS. 8 and 9 are schematic right side view of FIG. 2 showing the operation of the link mechanism 80. FIG. 8 shows the operation of the link mechanism 80 when accommodating bills in the bill accommodating box 2 and FIG. 9 shows the operation of the link mechanism 80 when taking out bills from the bill accommodating box 2.

One end portion of an arm member 84 is rotatably supported by a shaft 83 provided at the other end portion of the rotation member 82. The other end portion of the arm member 84 is rotatably supported by a shaft 87 provided at one end portion of a swing member 86 swingably supported by a shaft 85 which is fixed to the frame 22*b*. The other end portion of the swing member 86 is rotatably supported by a shaft 89 provided at one end portion of an arm member 88. The other end portion of the arm member 88 is rotatably supported by a shaft 92 provided at one end portion of a swing member 90 and one end portion of an arm member 91. The other end portion of the swing member 90 is swingably supported by a shaft 93 fixed to the frame 22*b* and the other end portion of the arm member 91 is rotatably supported by a shaft 95 provided at one end portion of a swing member 94. As shown in FIG. 2, the other end portion of the swing member 94 is fixed to the right end portion of a shaft 96 rotatably supported by the lower part of the frames 22*a*, 22*b*.

A solenoid 100 is fixed to the frame 22*b*. One end portion of a support member 102 is fixed to the tip end portion of an output shaft 101 of the solenoid 100 and the other end portion of the support member 102 is connected to one end portion of an arm member 104 via a shaft 103. The other end portion of the arm member 104 is rotatably connected via a shaft 105 to the swing member 86 in the vicinity of the shaft 85 by which the swing member 86 is swingably supported.

As shown in FIG. 3, five swing members 110 are fixed to the shaft 81 rotatably supported by the frames 22*a*, 22*b*.

Figure 10:
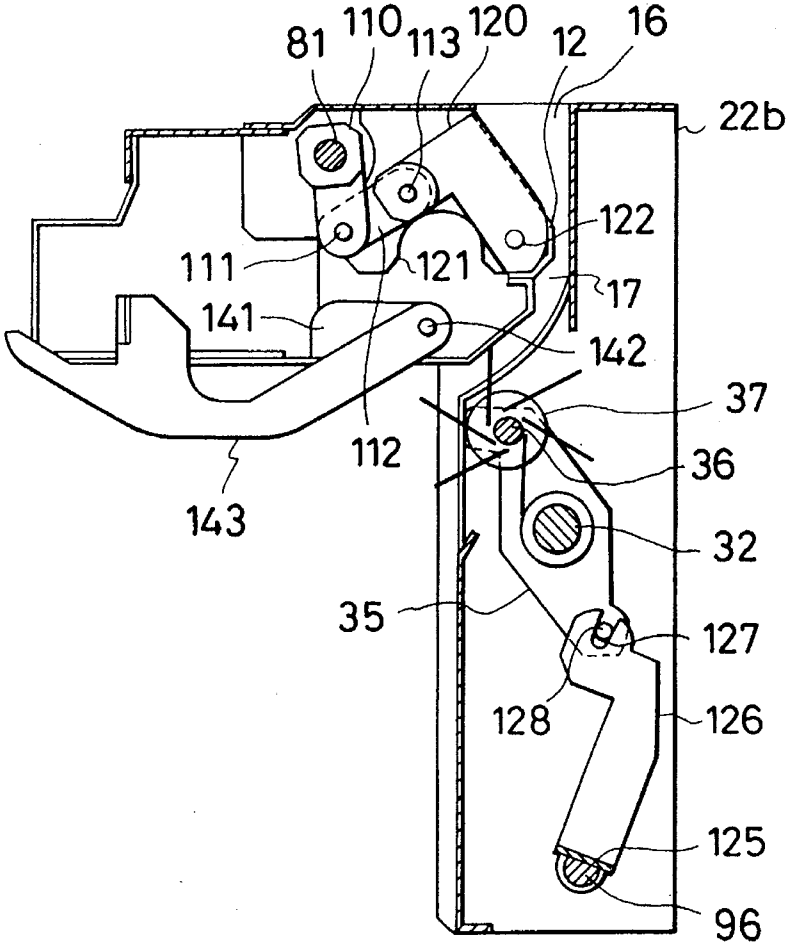
FIG. 10 is a schematic drawing showing a cross sectional drawing taken on line E—E in FIG. 3 when bills are being accommodated in a bill accommodating and feeding-out box.
Figure 11:
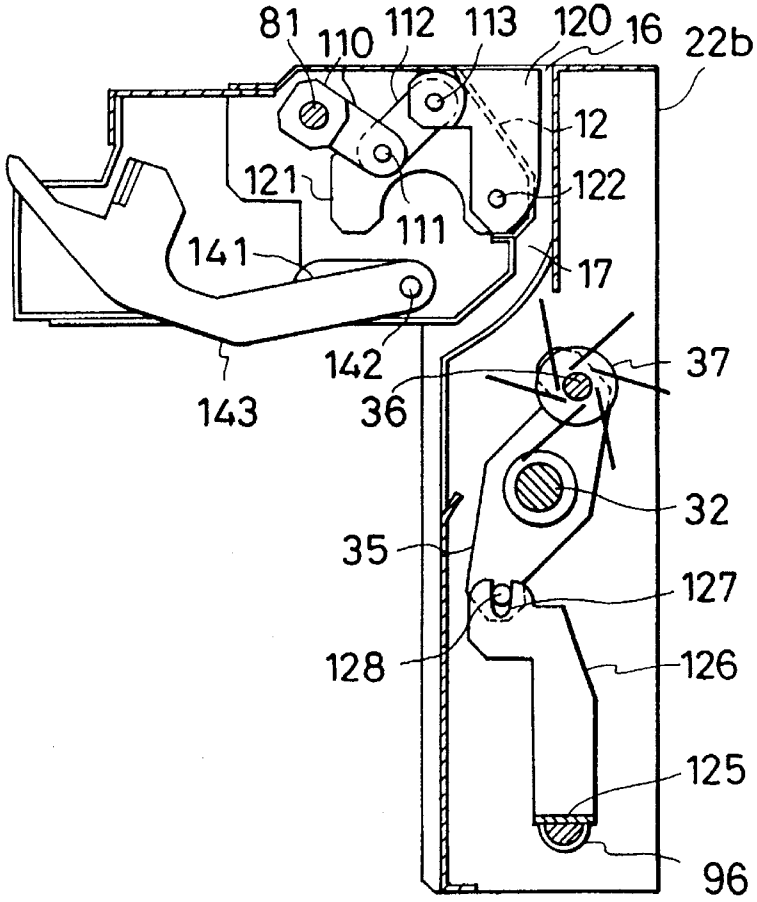
FIG. 11 is a schematic drawing showing a cross sectional drawing taken on line E—E in FIG. 3 when bills are being fed out from a bill accommodating and feeding-out box.

FIGS. 10 and 11 are schematic drawings showing a cross sectional view taken on line E—E. FIG. 10 is a drawing showing the state that bills are being accommodated in the bill accommodating box 2 and FIG. 11 is a drawing showing the state that bills are being taken out from the bill accommodating box 2.

Referring to FIGS. 10 and 11, one end portion of each arm member 112 is rotatably supported via a shaft 111 by the tip end portion of one of the swing members 110 and the other end portion of each arm member 112 is connected via a shaft 113 to one of bill receiving and dispensing opening adjusting members 120.

One end portion of each bill receiving and dispensing opening adjusting member 120 is rotatably supported via a shaft 122 by a support plate 121 provided in the guide member 12 and the other end portion thereof is connected to the arm member 112 via the shaft 113.

The thus constituted bill receiving and dispensing opening adjusting member 120 can enlarge or narrow the bill receiving and dispensing opening 16 by moving the output shaft 101 of the solenoid 100 vertically and rotating the shaft 81.

As shown in FIGS. 2, 10 and 11, a part of the shaft 96 rotatably supported by the frames 22*a*, 22*b* is formed with a cut portion 125 to which the lower end portion of a swing member 126 is fixed. The upper end portions of the swing member 126 are formed with engaging portions 127 and a pin 128 fixed to the lower end portion-of each support member 35 engages in one of the engaging portion 127.

The support members 35 are rotatably supported by the shaft 32 and the vane wheel 37 is rotatably supported by the upper end portion of each support member 35. When the solenoid 100 is driven, the driving force is transmitted from the solenoid 100 to the support members 35 via the shaft 96, the swing member 126, the engaging portions 127 and the pins 128, thereby rotating the support members 35 about the shaft 32 so as to move the vane wheels 37 with respect to the bill accommodating box 2.

As shown in FIG. 3, one end portion of a support member 131 is rotatably mounted on the shaft 23 and a shaft 132 to which a pair of feed-out rollers 130 are fixed is rotatably supported by the other end portion of the support member 131. As shown in FIG. 1, a part of each feed-out roller 130 is disposed so as to project into the bill accommodating box 2. In the vicinity of the frame 22*a*, a pulley 133 is fixed to the shaft 23 and a pulley 134 is fixed to the shaft 132. A belt 135 is engaged with the pulley 133 and the pulley 134.

Accordingly, when the shaft 23 is rotated by the first drive means (not shown) via the gear 24, the rotational force of the shaft 23 is transmitted to the shaft 132 via the pulley 133, the belt 135 and the pulley 134, thereby rotating the shaft 132 so that the feed-out rollers 130 are rotated in the same direction as that of the accommodating and feeding-out rollers 19*a*, 19*b*, 19*c*, 19*d* fixed to the shaft 23.

The support member 131 rotatably supporting the shaft 132 is integrally formed with a detection member 137 which can be detected by a sensor 136 provided in a frame (not shown). The detection member 137 and the sensor 136 are used for controlling the elevation of the elevator plate 21 when taking out bills from the bill accommodating box 2.

As shown in FIG. 1, a guide member 140 is provided above the bill accommodating box 2 and a support member 141 is fixed to the guide member 140. One end portion of each of four swing members 143 is mounted on the support member 141 so as to be swingable about a shaft 142. Each swing member 143 has such a shape that the opposite end portions are curved upwardly and the lower surface of substantially the central portion thereof abuts against the upper surface of the uppermost bill among bills accommodated in the bill accommodating box 2 by its dead weight so that it can be swung about the shaft 142 in accordance with the vertical movement of the elevator plate 21. Four swing members 143 has a single detection member 144 which can be detected by a sensor 145 provided in the guide member 140. The detection member 144 and the sensor 145 are used for controlling the lowering movement of the elevator plate 21 when accommodating bills in the bill accommodating box 2.

Figure 12:
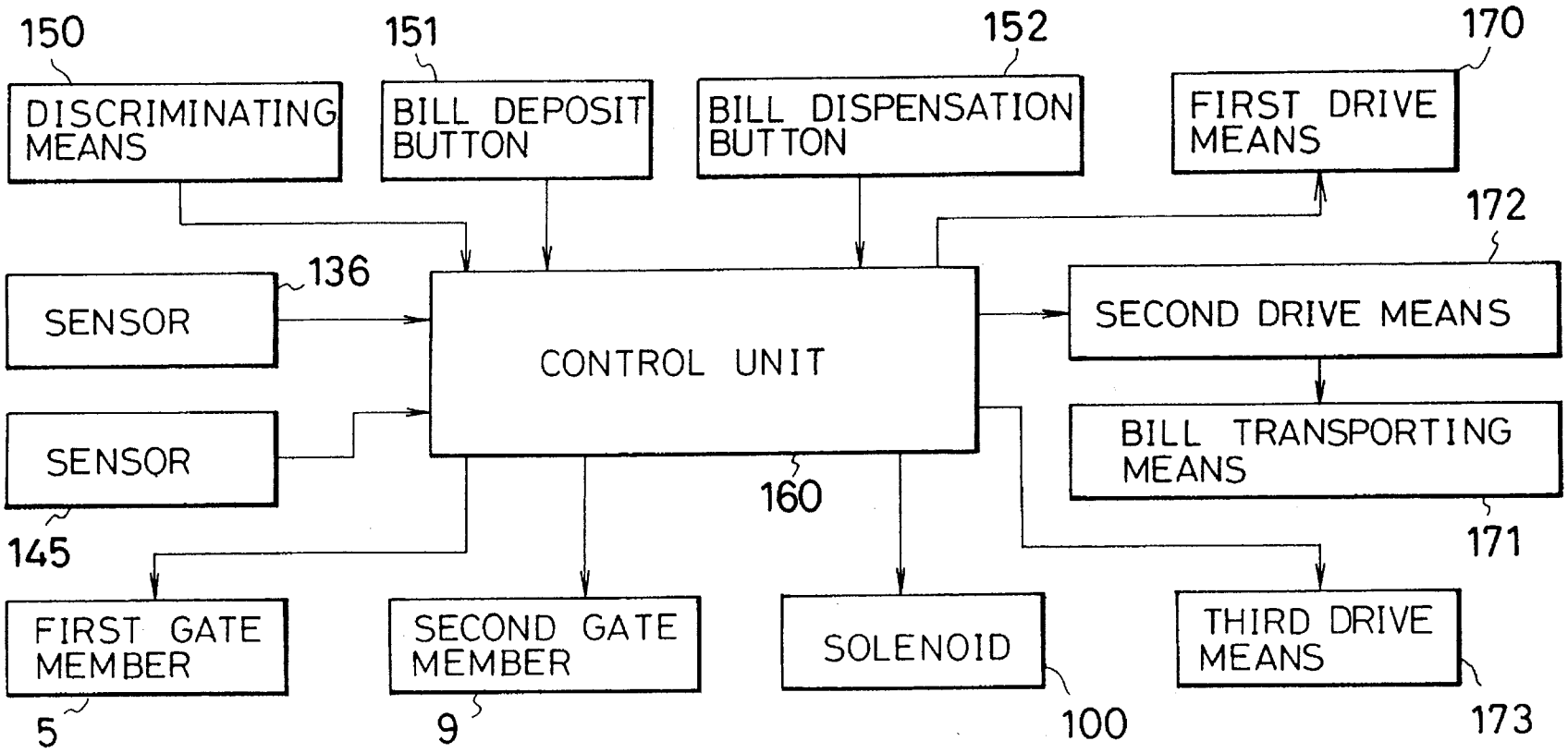
FIG. 12 is a block diagram showing a detection system, a control system and a drive system of a bill receiving and feeding-out apparatus for a bill receiving and dispensing machine which is an embodiment of the present invention, and a discriminating means.

FIG. 12 is a block diagram showing a detection system, a control system and a drive system of the thus constituted bill receiving and feeding-out apparatus for a bill receiving and dispensing machine which is an embodiment of the present invention and a discriminating means provided in the transporting passage 200 upstream of the bill receiving and feeding-out apparatus for discriminating whether or not received bills are acceptable, the denominations of received bills and whether the front side of the received bill faces upwardly or the back side thereof faces upwardly.

In FIG. 12, the detection system of the bill receiving and feeding-out apparatus comprises a sensor 136 for detecting the detection member 137, the sensor 145 for detecting the detection member 144, a bill deposit button 151 operated by an operator when depositing bills and a bill dispensation button 152 operated by the operator when dispensing bills. The drive system of the bill receiving and feeding-out apparatus comprises a first drive means 170 for driving the gear 24, a second drive means 172 for driving a bill transporting means 171 provided in the transporting passage 200 for transporting bills, a third drive means 173 for moving the elevator plate 21 vertically, the first gate member 5, the second gate member 9 and the solenoid 100. Further, the control system of the bill receiving and feeding-out apparatus comprises a control unit 160 and the control unit 160 receives discriminating signals from the discriminating means 150 provided in the transporting passage 200 upstream of the bill receiving and feeding-out apparatus for discriminating whether or not received bills are acceptable, the denominations of received bills and whether the front side of the received bill faces upwardly or the back side thereof faces upwardly, a detection signal from the sensor 136, a detection signal from the sensor 145, a bill depositing signal from the bill deposition button 151 and a bill dispensing signal from the bill dispensing button 152 and, based upon these input signals, outputs drive signals to the first drive means 170, the second drive means 172, the third drive means 173, the first gate member 5, the second gate member 9 and the solenoid 100.

The thus constituted bill receiving and feeding-out apparatus for a bill receiving and dispensing machine which is an embodiment of the present invention operates as follows.

In the case where bills are deposited into the bill receiving and dispensing machine, when the operator operates the bill depositing button 151, a preparatory bill receiving operation is started.

Figure 13:
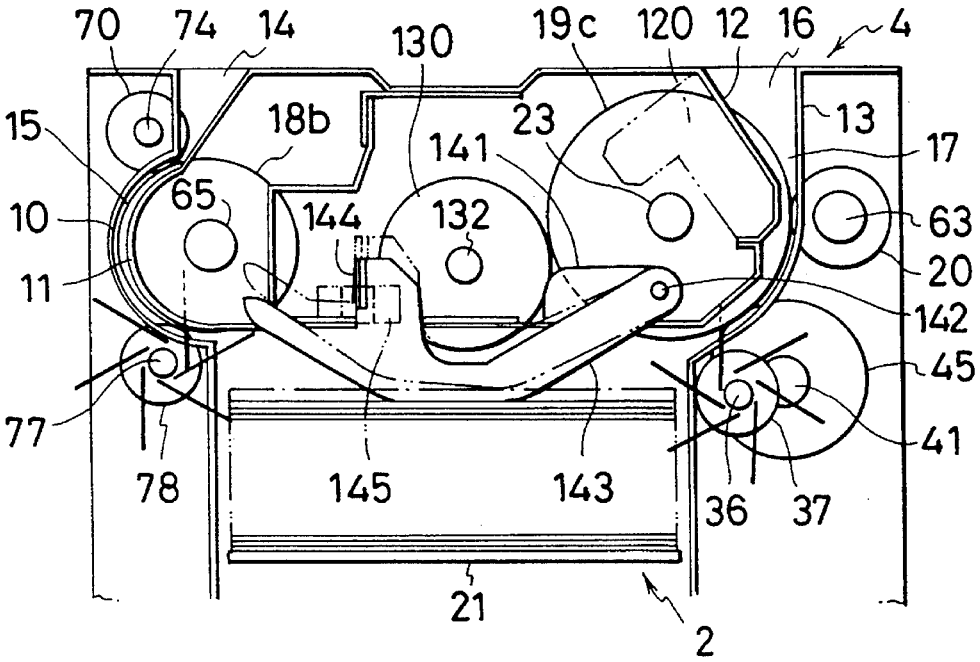
FIG. 13 is a schematic front view showing a swing member and sensor when a preparatory operation is being effected.

More specifically, the control unit 160 outputs a drive signal for lowering the elevator plate 21 to the third drive means 173, thereby lowering the elevator plate 21. As the elevator plate 21 is lowered, the swing members 143 which abut against the upper surface of the uppermost bill among bills stacked on the elevator plate 21 are also lowered. As a result, when the detection member 144 provided in the swing members 143 is detected by the sensor 145 disposed at a predetermined position, the detection signal is output from the sensor 145 to the control unit 160 and the control unit 160 stops outputting the drive signal to the third drive means 173, thereby stopping the lowering movement of the elevator plate 21. FIG. 13 is a schematic drawing showing a front view of the swing member 143 and the sensor 145 during the preparatory bill receiving operation.

Then, the control unit 160 outputs a first drive signal to the solenoid 100 and drives the solenoid 100 so that the output shaft 101 is drawn. As a result, the swing member 86 is swung about the shaft 85 clockwise in FIG. 8 via the support member 102, the arm member 104 and the shaft 105, whereby the swing member 86 draws the arm member 84 downwardly via the shaft 87 so that the rotation member 82 is rotated counterclockwise via the shaft 83. As a consequence, the shaft 81 is rotated clockwise in FIG. 10, thereby swinging the swing members 110 clockwise and swinging the bill receiving and dispensing opening adjusting members 120 counterclockwise about the shaft 122 via the shaft 111, the arm members 112 and the shaft 113. In this manner, when each of the bill receiving and dispensing opening adjusting members 120 is swung so that the side face thereof on the side of the guide member 13 is flush with the guide member 12, the control unit 160 stops outputting the first drive signal to the solenoid 100. Thus, the space of the bill receiving and dispensing opening 16 facing the bill receiving passage 6 and the bill dispensing passage 8 is enlarged.

When the control unit 160 outputs the first drive signal to the solenoid 100 and the output shaft 101 is drawn so that the swing member 86 is swung clockwise in FIG. 8, the shaft 89 is moved to the left and upwardly and the swing member 90 and the arm member 91 are swung counterclockwise in FIG. 8 via the arm member 88 and shaft 92, whereby the swing member 94 is swung counterclockwise in FIG. 8 via the shaft 95.

As a result, the shaft 96 is rotated clockwise in FIG. 10 and the swing member 126 fixed to the cut portion 125 formed in the shaft 96 is swung clockwise. Therefore, the support members 35 are swung counterclockwise in FIG. 10 about the shaft 32 via the engaging portions 127 and the pins 128, whereby a part of each vane wheel 37 mounted on the upper end portion of one of the support members 35 is moved into the bill accommodating box 2.

When a part of each vane wheel 37 is moved into the bill accommodating box 2, a force is applied from the bills stacked on the elevator plate 21 to each of the vane wheels 37 so as to retract the vane wheel 37 from the bill accommodating box 2 and a clockwise force acts on the shaft 96 in FIG. 8. However, as shown in FIG. 8, since the shaft 93 is located on the straight line drawn between the shaft 92 and the shaft 95, even if the clockwise force acts on the shaft 96 in FIG. 8, the shaft 96 is not rotated clockwise and, therefore, a part of each vane wheel 37 is held at a predetermined position in the bill accommodating box 2.

In this embodiment, the positions of the respective shafts and lengths of the respective swing members and arm members are set in such a manner that when outputting the first drive signal to the solenoid 100 is stopped, each of the bill receiving and dispensing opening adjusting members 120 is swung until the side face thereof on the side of the guide member 13 becomes flush with the guide member 12 and that a part of each of the vane wheels 37 is moved at a predetermined position in the bill accommodating box 2.

In this manner, when the preparatory bill depositing operation has been completed, a bill receiving operation is started and the second drive means 172 for driving the bill transporting means 171 which transports bills is driven by the control unit 160, whereby the bills are transported in the transporting passage 200 into the bill receiving and dispensing machine.

After the received bills were transported in the transporting passage 200 and were discriminated by the discriminating means 150 as to whether or not they are counterfeit and whether or not they are foreign bills, namely, whether or not they are acceptable, the denominations of the bills and whether the front side of the bill faces upwardly or the back side thereof faces upwardly, the bills are fed in the transporting passage 200 toward the bill receiving and feeding-out apparatus 1 as indicated by an arrow in FIG. 1.

When the control unit 160 judges, in accordance with discrimination signals from the discriminating means 150, that the bill of denomination to be taken in the bill receiving and feeding-out apparatus 1 has been fed to the transporting passage 200 immediately upstream of the first gate member 5 thereof, it actuates the first gate member 5 so as to be located at a taking-in position indicated by a chain line in FIG. 1, thereby taking the bill in the bill receiving and feeding-out apparatus 1. On the other hand, when the control unit 160 judges that the bill having been fed to the transporting passage 200 immediately upstream of the first gate member 5 is not the bill to be taken in the bill receiving and feeding-out apparatus 1, it holds the first gate member 5 at its retracted position without actuating it, whereby the bill is further transported downstream in the transporting passage 200.

Further, the control unit 160 judges, in accordance with discrimination signals from the discriminating means 150, whether or not it is necessary to reverse the bill having been taken in the bill receiving and feeding-out apparatus 1 in order to accommodate the bill in the bill accommodating box 2 in such a manner that the front side of the bill faces upwardly.

As a result, when the control unit 160 judges that it is unnecessary to reverse the bill, it locates the second gate member 9 at a position indicated by a chain line in FIG. 1, thereby feeding the bill into the bill receiving passage 6 and further into the bill receiving and dispensing opening 16 of the bill receiving and feeding-out mechanism 4. Since the space of the bill receiving and dispensing opening 16 facing the bill receiving passage 6 and the bill dispensing passage 8 has been enlarged, the bill can be reliably received by the bill receiving and dispensing opening 16.

On the contrary, when the control unit 160 judges that it is necessary to reverse the bill, it locates the second gate member 9 at a position indicated by a dotted line in FIG. 1, thereby feeding the bill into the bill reversing and receiving passage 7 and further into the bill receiving opening 14 of the bill receiving and feeding-out mechanism 4.

Further, the gear 24 is rotated clockwise in FIG. 4 by the first drive means 170, whereby the driving force of the first driving means 170 is transmitted from the gear 24 to the gear 30 via the gear 29, the gear 27 and the gear 28 and the gear 30 is rotated counterclockwise in FIG. 4. The shaft 23 and the accommodating and feeding-out rollers 19*a*, 19*b*, 19*c*, 19*d* fixed to the shaft 23 are also rotated clockwise.

When the accommodating and feeding-out rollers 19*a*, 19*b*, 19*c*, 19*d* are rotated clockwise, the separation rollers 45 abutting against the accommodating and feeding-out rollers 19*b*, 19*c* are rotated counterclockwise and the gear 48 is rotated clockwise via the gear 46. As a result, the gear 48 is rotated clockwise in FIG. 7 with respect to the shaft 32 and the one-way clutch 47 does not transmit the driving force of the gear 48 to the shaft 32.

On the other hand, the counterclockwise rotational force of the separation rollers 45 is transmitted to the one-way clutches 50 via the shaft 41 and since the one-way clutches 50 transmit the rotational force of the shaft 41 to the gears 51 only when the shaft 41 is rotated counterclockwise in FIG. 6 with respect to the gear 51, the vane wheels 37 are rotated counterclockwise via gears 39 and the gears 38, whereby bills are led by the vane wheels 37 into the bill accommodating box 2.

Since the separation rollers 45 are disposed so as to abut against the accommodating and feeding-out rollers 19*b*, 19*c*, they are rotated counterclockwise by a frictional force produced between themselves and the accommodating and feeding-out rollers 19*b*, 19*c* rotating clockwise in FIG. 7 and the shaft 41 integrally formed with the separation rollers 45 are also rotated counterclockwise. As a result, as shown in FIG. 6, the rotational force of the shaft 41 is transmitted to the gears 51 via the one-way clutches 50 and the gears 39 each of which meshes with one of the gears 51 is rotated clockwise in FIG. 6. Therefore, as shown in FIG. 5, the gears 38 rotating together with the vane wheels 37 are rotated counterclockwise by the gears 39 and the vane wheels 37 are rotated counterclockwise in FIGS. 1 and 13, thereby leading the bill fed from the bill receiving and dispensing opening 16 to the bill accommodating and feeding-out passage 17 into the bill accommodating box 2.

Since the swing members 143 are swingable about the shaft 142 and as shown in FIG. 10, the bill accommodating and feeding-out passage 17 opens to a portion below the shaft 142, the bill fed from the bill receiving and dispensing opening 16 to the bill accommodating and feeding-out passage 17 is led to below the swing members 143 by the vane wheels 37 so that the bill is stacked on the elevator plate 21 in the bill accommodating box 2.

As shown in FIGS. 3 and 4, when the gear 61 is rotated clockwise in FIG. 4 together with the gear 24, the gear 61 rotates the gear 62 and the shaft 63 counterclockwise in FIG. 4 and rotates a pair of the feed rollers 20 fixed to the shaft 63 counterclockwise in FIG. 1, while the feed rollers 20 are abutting against the accommodating and feeding-out rollers 19*a*, 19*d*.

On the other hand, when the shaft 63 is rotated counterclockwise in FIG. 4, as shown in FIG. 3, the accommodating rollers 18*a*, 18*b* are rotated counterclockwise in FIG. 1 via the pulley 67 fixed to the shaft 63, the belt 68, the pulley 66, the one-way clutch (not shown) and the shaft 65. As a result, the feed rollers 70 abutting against the accommodating rollers 18*a*, 18*b* and the feed rollers 71 integrally formed with the vane wheels 78 are rotated clockwise by a frictional force produced between themselves and the accommodating rollers 18*a*, 18*b*.

Therefore, the bill fed from the bill reversing and receiving passage 7 to the bill accommodating passage 15 via the bill receiving opening 14 is transported toward the bill accommodating box 2 and is led by the vane wheels 78 rotating together with the feed rollers 71 into the bill accommodating box 2. Since each of the swing members 143 abutting against the upper surface of the uppermost bill among bills stacked on the elevator plate 21 in the bill accommodating box 2 by its dead weight is swingably mounted on the shaft 142 and has such a shape that the opposite ends thereof are curved upwardly, the bill is fed to below the swing members 143 and stacked on the elevator plate 21 in the bill accommodating box 2.

Thus, when the bills have been successively fed from the bill accommodating and feeding-out passage 17 and the bill accommodating passage 15 to the bill accommodating box 2 and stacked on the elevator plate 21, as shown in FIG. 13, the swing members 143 are gradually lifted by the stacked bills and it becomes impossible for the sensor 145 to detect the detection member 144. When the sensor 145 cannot detect the detection member 144, the control unit 160 outputs a drive signal to the third drive means 173 and lowers the elevator plate 21 until the sensor 145 detects the detection member 144.

In this way, since the elevator plate 21 is lowered in accordance with the number of bills accommodated in the bill accommodating box 2 in such a manner that the upper surface of the uppermost bill among the bills stacked on the elevator plate 21 is held at substantially the same position in the vertical direction, it is possible to feed bills from the bill accommodating and feeding-out passage 17 and the bill accommodating passage 15 to the bill accommodating box 2 under substantially the same condition.

Thus, when the bill receiving operation to the bill accommodating box 2 has been completed, the control unit 160 outputs drive stop signals to the second drive means 172 for driving the bill transporting means for transporting bills and the first drive means 170 for driving the gear 24.

As described above, according to this embodiment, the discriminating means 150 provided in the transporting passage 200 discriminates whether or not the bills are acceptable, the denominations of the bills and whether the front side or the back side of the bill faces upwardly and the bills are taken in by the corresponding bill receiving and feeding-out apparatus 1 based upon the results of the discrimination. Further, when the bill is to be accommodated in the bill accommodating box 2 in such a manner that the front side thereof faces upwardly, the bill the back side of which faces upwardly is fed into the bill reversing and receiving passage 7 so as to be reversed and fed into the bill accommodating box 2 via the bill receiving opening 14 and the bill accommodating passage 15. On the other hand, the bill the front side of which faces upwardly is fed into the bill receiving passage 6 and is fed into the bill accommodating box 2 via the bill receiving and dispensing opening 16 and the bill accommodating and feeding-out passage 17 without being reversed. Therefore, the bills deposited into the bill receiving and dispensing machine can be accommodated in accordance with their denominations in the corresponding bill accommodating box 2 in such a manner that the front sides thereof face upwardly.

On the contrary, when an operator operates a bill dispensing button 152 and the bills are to be dispensed, a preparatory dispensing operation is started.

More specifically, the control unit 160 outputs a drive signal to the third drive means 173 for moving the elevator plate 21 vertically, thereby elevating the elevator plate 21. As a result, the swing members 143 abutting the upper surface of the uppermost bill among bills stacked on the elevator plate 21 by their dead weight are lifted so that the uppermost bill comes into abutment against the feed-out rollers 130 and presses them upwardly. Since the support member 131 supporting the feed-out rollers 130 is rotatably supported by the shaft 23, it is lifted together with the feed-out rollers 130.

Thus, when the support member 131 and the feed-out rollers 130 are lifted until the detection member 137 provided in the support member 131 is detected by the sensor 136, the control unit 160 outputs a drive stop signal to the third drive means 173, thereby stopping the elevation of the elevator plate 21.

Then, the control unit 160 outputs a second drive signal to the solenoid 100 and projects the output shaft 101 of the solenoid 100 upwardly. As a result, the swing member 86 is swung counterclockwise in FIG. 9 about the shaft 85 via the support member 102, the arm member 104 and the shaft 105 so as to lift the arm member 84 via the shaft 87, whereby the rotation member 82 rotates clockwise. Therefore, the shaft 81 is rotated counterclockwise in FIG. 11 so as to rotate the swing members 110 counterclockwise, thereby swinging the bill receiving and dispensing opening adjusting members 120 clockwise about the shaft 122 via the shaft 111, the arm members 112 and the shaft 113. In this way, when the bill receiving and dispensing opening adjusting members 120 are swung so that the side faces of the bill receiving and dispensing opening adjusting members 120 on the side of the guide member 13 are positioned in parallel with the guide member 13, the control unit 160 stops outputting the second drive signal to the solenoid 100. Thus, the space of the bill receiving and dispensing opening 16 is narrowed so as to face only the bill dispensing passage 8.

When the control unit 160 outputs the second drive signal to the solenoid 100 and the output shaft 101 is projected upwardly so that the swing member 86 is swung about the shaft 85 counterclockwise in FIG. 9, the shaft 89 is moved downwardly and to the right and the swing member 90 and the arm member 91 are swung clockwise via the arm member 88 and the shaft 92, whereby the swing member 94 is swung clockwise in FIG. 9 via the shaft 95.

As a result, the shaft 96 is rotated counterclockwise in FIG. 11 and the swing member 126 fixed to the cut portion 125 formed in the shaft 96 is swung counterclockwise. As a consequence, the support members 35 are swung about the shaft 32 clockwise in FIG. 11 and each of the vane wheels 37 mounted on the upper portion of one of the support members 35 is retracted from the bill accommodating box 2.

Although the bill receiving and dispensing opening adjusting members 120 are subjected to a force toward the guide member 12 in FIG. 11 by the bills taken out into the bill accommodating and feeding-out passage 17 and the shaft 81 is subjected to a counterclockwise force in FIG. 9, as shown in FIG. 9, since the shaft 87 is positioned on the left side of the straight line drawn between the shaft 83 and the shaft 85, the shaft 87 is prevented from rotating clockwise and the bill receiving and dispensing opening adjusting members 120 are held at their predetermined positions.

Further, the control unit 160 locates the first gate member 5 and the second gate member 9 at positions indicated by chain lines in FIG. 1.

Thus, after the preparatory dispensing operation was completed, the control unit 160 drives the first drive means 170 so that the gear 24 is rotated counterclockwise in FIG. 4. As a result, the shaft 23 and the accommodating and feeding-out rollers 19*a*, 19*b*, 19*c*, 19*d* are rotated counterclockwise.

When the shaft 23 is rotated counterclockwise, the gear 29 fixed to the shaft 23 rotates the gear 30 clockwise in FIG. 4 via the gears 27, 28 and the driving force of the gear 30 can be transmitted to the shaft 32 via the torque limiter 31.

However, when the accommodating and feeding-out rollers 19*a*, 19*b*, 19*c*, 19*d* are rotated counterclockwise, if the accommodating and feeding-out rollers 19*b*, 19*c* and the separation rollers 45 directly abut against each other or if one bill is held between the accommodating and feeding-out rollers 19*b*, 19*c* and the separation rollers 45, the driving force of the accommodating and feeding-out rollers 19*b*, 19*c* is transmitted to the separation rollers 45 and the separation rollers 45 are rotated clockwise. As a consequence, the gear 46 is rotated clockwise and the gear 48 is rotated counterclockwise so that the shaft 32 is rotated counterclockwise via the one-way clutch 47.

Accordingly, since the shaft 32 is rotated clockwise, while the gear 30 is rotated counterclockwise, the difference in torque between the gear 30 and the shaft 32 is great and the torque limiter 31 causes the shaft 32 to slip with respect to the gear 30 so that the shaft 32 is rotated counterclockwise by the driving force transmitted from the accommodating and feeding-out rollers 19*b*, 19*c* via the separation rollers 45, the gear 46 and the gear 48.

On the contrary, if the two or more bills are simultaneously taken out to between the accommodating and feeding-out rollers 19*b*, 19*c* and the separation rollers 45 and they are held between the accommodating and feeding-out rollers 19*b*, 19*c* and the separation rollers 45, since a frictional force produced between adjacent bills is small, instantaneous slippage occurs between the accommodating and feeding-out rollers 19*b*, 19*c* and the separation rollers 45 and the driving force cannot be not transmitted from the accommodating and feeding-out rollers 19*b*, 19*c* to the separation rollers 45. Therefore, since the driving force is not transmitted from the shaft 23 to the shaft 32 via the accommodating and feeding-out rollers 19*b*, 19*c* , the difference in torque between the gear 30 and the shaft 32 is small and the rotational force of the gear 30 is transmitted to the shaft 32 by the torque limiter 31, whereby the shaft 32 is rotated clockwise. As a result, the rotational force of the shaft 32 is transmitted to the gear 48 by the one-way clutch 47 and the separation rollers 45 are rotated counterclockwise via the gear 46, whereby a separation force is applied to two or more bills taken out to between the accommodating and feeding-out rollers 19*b*, 19*c* and the separation rollers 45 from the accommodating and feeding-out rollers 19*b*, 19*c* and the separation rollers 45 and the bills are taken out one by one. Bills separated by the separation rollers 45 are led into the bill accommodating box 2.

Further, if the separation rollers 45 are rotated clockwise together with the accommodating and feeding-out rollers 19*b*, 19*c*, although the shaft 41 is rotated together with the separation rollers 45, since the one-way clutches 50 do not transmit the rotational force of the shaft 41 to the gears 51, no driving force is transmitted to the gears 39 and, therefore, the vane wheels 37 cannot be rotated.

In FIGS. 3 and 4, when the gear 24 is rotated counterclockwise, whereby the gear 61 is rotated counterclockwise via the shaft 23, the gear 62 is rotated clockwise and the feed rollers 20 are rotated clockwise, while they are abutting against the accommodating and feeding-out rollers 19*a*, 19*d*.

Figure 14:
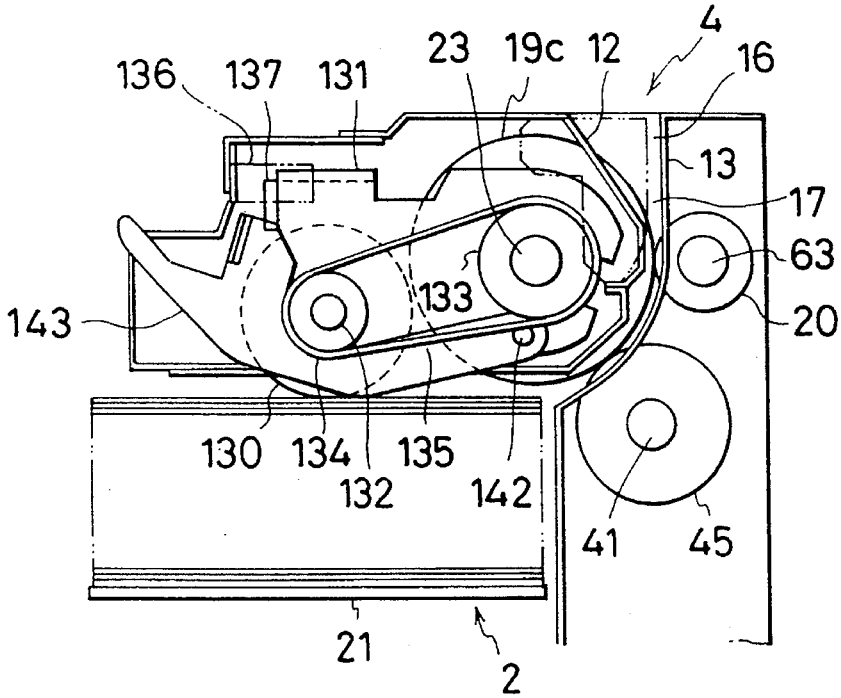
FIG. 14 is a schematic front view showing an accommodating and feeding-out roller and a feed-out roller.

FIG. 14 is a schematic front view showing the accommodating and feeding-out rollers 19*a*, 19*b*, 19*c*, 19*d* and the feed-out rollers 130 when dispensing bills. As shown in FIG. 14, when the shaft 23 is rotated, the pulley 133 mounted on the shaft 23 rotates the shaft 132 via the belt 135 and the pulley 134 in the same direction as that of the shaft 23, whereby the feed-out rollers 130 are rotated in the same direction as that of the accommodating and feeding-out rollers 19*a*, 19*b*, 19*c*, 19*d*.

In this way, when the shaft 23 is rotated by the first drive means 170 and the accommodating and feeding-out rollers 19*a*, 19*b*, 19*c*, 19*d* are rotated, the feed-out rollers 130 are rotated so that the uppermost bill among bills stacked on the elevator plate 21 is fed out by the feed-out rollers 130 from the bill accommodating box 2 into the bill accommodating and feeding-out passage 17. The bills fed out into the bill accommodating and feeding-out passage 17 are fed to between the accommodating and feeding-out rollers 19*b*, 19*c* and the separation rollers 45 and separated one by one so as to be fed into the bill receiving and dispensing opening 16. Since when dispensing bills, the space of the bill receiving and dispensing opening 16 is narrowed so as to face only the bill dispensing passage 8, the bills fed into the bill receiving and dispensing opening 16 can be reliably fed into the bill dispensing, opening 8 and dispensed through the transaction opening (not shown).

In this manner, when the bills are dispensed from the bill accommodating box 2 and it becomes impossible for the sensor 136 to detect the detection member 137 provided in the support member 131, the control unit 160 outputs a drive signal to the third drive means 173 and elevates the elevator plate 21 until the sensor 136 detects the detection member 137 provided in the support member 131 and the control unit 160 receives a detection signal. Therefore, since the uppermost bill among bills stacked on the elevator plate 21 and the feed-out rollers 130 abut against each other by substantially a constant pressure, it is possible to reliably feed out the bills by the feed-out rollers 130 from the bill accommodating box 2.

According to this embodiment, since the bill reversing mechanism 3 for feeding bills into the bill accommodating box 2 so that bills are accommodated in such a manner that the front sides thereof face upwardly and the bill receiving and feeding-out mechanism 4 for accommodating bills in the bill accommodating box 2 or feeding out bills from the bill accommodating box 2 are disposed above the bill accommodating box 2 for accommodating deposited bills and storing bills to be dispensed, it is possible to make the bill receiving and feeding-out mechanism compact.

The present invention has thus been shown and described with reference to a specific embodiment. However, it should be noted that the present invention is in no way limited to the details of the described arrangements but changes and modifications may be made without departing from the scope of the appended claims.

For example, in the above described embodiment, the bill receiving and feeding-out apparatus 1 is used for accommodating bills deposited into the bill receiving and dispensing machine and having corresponding denomination and dispensing them. However, it is possible to provide a plurality of bill dispensing boxes for storing bills to be dispensed having different denominations from each other in the bill receiving and dispensing machine and to use the bill receiving and feeding-out apparatus 1 as a bill receiving box for receiving bills deposited into the bill receiving and dispensing machine in such a manner that the front sides thereof face upwardly and replenishing a certain bill dispensing box in which bills run short with bills therefrom. Further, it is also possible to make the bill receiving and feeding-out apparatus 1 to be able to attach to and remove from the bill receiving and dispensing machine and to use the bill receiving and feeding-out apparatus 1 as a bill receiving box in such a manner that bills of various denominations are accommodated in the bill accommodating box 2 and the bill receiving and feeding-out apparatus 1 is attached to the bill receiving and dispensing machine so as to feed bills accommodated in the bill accommodating box 2 to the bill dispensation boxes prior to starting operation and that the bill receiving and feeding-out apparatus 1 receives bills such that the front sides thereof face upwardly and replenish a certain bill dispensing box in which bills run short with bills therefrom.

Further, in the above described embodiment, although bills are accommodated in the bill accommodating box 2 in such a manner that the front sides thereof face upwardly, it is possible to accommodate bills in the bill accommodating box 2 in such a manner that the back sides thereof face upwardly.

According to the present invention, it is possible to provide a compact bill receiving and feeding-out apparatus capable of accommodating bills in such a manner that either the front sides or the back sides thereof face upwardly and feeding out the bills as occasion demands.

I claim:

1. A bill receiving and feeding-out apparatus for a bill receiving and dispensing machine connectable to a transporting passage in the bill receiving and dispensing machine comprising a bill accommodating box for accommodating bills, a bill reversing mechanism which comprises a bill reversing passage for reversing and feeding bills into the bill accommodating box, a bill non-reversing passage for feeding bills into the bill accommodating box without reversing them, a bill feeding-out passage for feeding out bills from the bill accommodating box to the transporting passage, a first gate means for selectively taking in acceptable bills in accordance with the results of discrimination made by a discriminating means provided in the transporting passage as to whether or not bills are acceptable, the denominations of bills and whether the front sides or the back sides of bills face upwardly and second gate means for selectively feeding bills to either the bill reversing passage or the bill non-reversing passage based upon the results of discrimination made by the discriminating means, and a bill receiving and feeding-out mechanism which comprises a bill accommodating passage connected to the downstream end portion of the bill reversing passage and connected to the upper portion of the bill accommodating box at the downstream end portion thereof for feeding bills from the bill reversing passage to the bill accommodating box, a bill receiving and feeding-out opening facing the downstream end portion of the bill non-reversing passage and the upstream end portion of the bill feeding-out passage and a bill accommodating and feeding-out passage connected to the bill receiving and feeding-out opening at one end and to the upper portion of the bill accommodating box at the other end and adapted for feeding bills into the bill accommodating box and feeding out bills from the bill accommodating box, said bill reversing mechanism being disposed above the bill receiving and feeding-out mechanisms, said bill receiving and feeding-out apparatus further comprising an adjusting means for enlarging the bill receiving and feeding-out opening so as to face the bill non-reversing passage and the bill feeding-out passage when accommodating bills into the bill accommodating box and narrowing the bill receiving and feeding-out opening so as to face only the bill feeding-out passage when feeding out bills from the bill accommodating box.

2. A bill receiving and feeding-out apparatus in accordance with claim 1 which further comprises bill accommodating rollers provided in the bill accommodating passage and bill accommodating and feeding-out rollers provided in the bill accommodating and feeding-out passage.

3. A bill receiving and feeding-out apparatus in accordance with claim 1 which further comprises an elevator plate movable vertically provided in the bill accommodating box for holding bills so as to be stacked on the upper surface thereof.

4. A bill receiving and feeding-out apparatus in accordance with claim 2 which further comprises an elevator plate movable vertically provided in the bill accommodating box for holding bills so as to be stacked on the upper surface thereof.

5. A bill receiving and feeding-out apparatus in accordance with claim 2 wherein vane wheels are provided at a position opposite to the bill accommodating rollers with respect to the bill accommodating passage and wherein vane wheels are provided at a position opposite to the bill accommodating and feeding-out rollers with respect to the bill accommodating and feeding-out passage.

6. A bill receiving and feeding-out apparatus in accordance with claim 4 wherein vane wheels are provided at a position opposite to the bill accommodating rollers with respect to the bill accommodating passage and wherein vane wheels are provided at a position opposite to the bill accommodating and feeding-out rollers with respect to the bill accommodating and feeding-out passage.

7. A bill receiving and feeding-out apparatus in accordance with claim 2 wherein the circumferential surface of each of the bill accommodating rollers is made of a friction material and wherein the circumferential surface of each of the bill accommodating and feeding-out rollers is made of a friction material.

8. A bill receiving and feeding-out apparatus in accordance with claim 4 wherein the circumferential surface of each of the bill accommodating rollers is made of a friction material and wherein the circumferential surface of each of the bill accommodating and feeding-out rollers is made of a friction material.

9. A bill receiving and feeding-out apparatus in accordance with claim 5 wherein the circumferential surface of each of the bill accommodating rollers is made of a friction material and wherein the circumferential surface of each of the bill accommodating and feeding-out rollers is made of a friction material.

10. A bill receiving and feeding-out apparatus in accordance with claim 6 wherein the circumferential surface of each of the bill accommodating rollers is made of a friction material and wherein the circumferential surface of each of the bill accommodating and feeding-out rollers is made of a friction material.

11. A bill receiving and feeding-out apparatus for a bill receiving and dispensing machine connectable to a transporting passage in the bill receiving and dispensing machine, comprising;

a bill accommodating box for accommodating bills, a bill reversing mechanism which comprises a bill reversing passage for reversing and feeding bills into the bill accommodating box, a bill non-reversing passage for feeding bills into the bill accommodating box without reversing them, a bill feeding-out passage for feeding out bills from the bill accommodating box to the transporting passage, a first gate for selectively taking in acceptable bills, and a second gate for selectively feeding bills to either the bill reversing passage or the bill non-reversing passage, and a bill receiving and feeding-out mechanism which comprises a bill accommodating passage connected to the downstream end portion of the bill reversing passage and connected to the upper portion of the bill accommodating box at the downstream end portion thereof for feeding bills from the bill reversing passage to the bill accommodating box, a bill receiving and feeding-out opening facing the downstream end portion of the bill non-reversing passage and the upstream end portion of the bill feeding-out passage, and a bill accommodating and feeding-out passage connected to the bill receiving and feeding-out opening at one end and to the upper portion of the bill accommodating box at the other end and adapted for feeding bills into the bill accommodating box and feeding out bills from the bill accommodating box, said bill reversing mechanism being disposed above the bill receiving and feeding-out mechanism, said bill receiving and feeding-out apparatus further comprising an adjusting means for enlarging the bill receiving and feeding-out opening so as to face the bill non-reversing passage and the bill feeding-out passage when accommodating bills into the bill accommodating box and narrowing the bill receiving and feeding-out opening so as to face only the bill feeding-out passage when feeding out bills from the bill accommodating box.

12. A bill receiving and feeding-out apparatus in accordance with claim 11 which further comprises bill accommodating rollers provided in the bill accommodating passage and bill accommodating and feeding-out rollers provided in the bill accommodating and feeding-out passage.

13. A bill receiving and feeding-out apparatus in accordance with claim 11 which further comprises an elevator plate movable vertically provided in the bill accommodating box for holding bills so as to be stacked on the upper surface thereof.

14. A bill receiving and feeding-out apparatus in accordance with claim 12 which further comprises an elevator plate movable vertically provided in the bill accommodating box for holding bills so as to be stacked on the upper surface thereof.

15. A bill receiving and feeding-out apparatus in accordance with claim 12 wherein vane wheels are provided at a position opposite to the bill accommodating rollers with respect to the bill accommodating passage and wherein vane wheels are provided at a position opposite to the bill accommodating and feeding-out rollers with respect to the bill accommodating and feeding-out passage.

16. A bill receiving and feeding-out apparatus in accordance with claim 14 wherein vane wheels are provided at a position opposite to the bill accommodating rollers with respect to the bill accommodating passage and wherein vane wheels are provided at a position opposite to the bill accommodating and feeding-out rollers with respect to the bill accommodating and feeding-out passage.

17. A bill receiving and feeding-out apparatus in accordance with claim 12 wherein the circumferential surface of each of the bill accommodating rollers is made of friction material and wherein the circumferential surface of each of the bill accommodating and feeding-out rollers is made of a friction material.

18. A bill receiving and feeding-out apparatus in accordance with claim 14 wherein the circumferential surface of each of the bill accommodating rollers is made of a friction material and wherein the circumferential surface of each of the bill accommodating and feeding-out rollers is made of a friction material.

19. A bill receiving and feeding-out apparatus in accordance with claim 15 wherein the circumferential surface of each of the bill accommodating rollers is made of a friction material and wherein the circumferential surface of each of the bill accommodating and feeding-out rollers is made of a friction material.

20. A bill receiving and feeding-out apparatus in accordance with claim 16 wherein the circumferential surface of each of the bill accommodating rollers is made of a friction material and wherein the circumferential surface of each of the bill accommodating and feeding-out rollers is made of a friction material.

* * * * *